United States Patent [19]

Urbani

[11] Patent Number: 4,584,969

[45] Date of Patent: Apr. 29, 1986

[54] DIRTY WATER HEAT EXCHANGER

[76] Inventor: William G. Urbani, 2520 Benjamin Holt Rd., Stockton, Calif. 95207

[21] Appl. No.: 654,612

[22] Filed: Sep. 25, 1984

[51] Int. Cl.[4] ..... F22B 7/00; F22B 31/02

[52] U.S. Cl. ..... 122/136 R; 122/158; 122/160; 122/161; 165/81

[58] Field of Search ..... 122/16, 43, 138, 140 R, 122/142, 149, 161, 160, 158, 183; 165/81, 82

[56] References Cited

U.S. PATENT DOCUMENTS

| | | | |
|---|---|---|---|
| 2,787,256 | 4/1957 | Ilune | 122/161 X |
| 3,133,527 | 5/1964 | Mizer . | |
| 3,389,692 | 6/1968 | Johnson et al. . | |
| 4,252,087 | 2/1981 | Kime . | |
| 4,282,833 | 8/1981 | Giesen | 122/183 X |
| 4,329,943 | 5/1982 | Schworer | 122/161 X |
| 4,356,794 | 11/1982 | Bouman et al. | 122/161 X |
| 4,440,213 | 4/1984 | Sarvis | 165/81 X |

FOREIGN PATENT DOCUMENTS

| | | | |
|---|---|---|---|
| 348389 | 2/1905 | France | 122/183 |

*Primary Examiner*—Edward G. Favors

*Attorney, Agent, or Firm*—Townsend and Townsend

[57] ABSTRACT

A dirty water heat exchanger keeps solids from settling out while passing through the heat exchanger and includes a cylindrical furnace duct, connected at a first end to a conventional burner, having a spiral liquid heating duct along which the dirty water passes from its first end to its second end. The second end of the furnace duct is open. An exhaust tube surrounds the furnace duct and provides an annular exhaust gap for the hot gases to flow back over the outer surface of the spiral liquid heating duct. The outer end of the exhaust tube is closed to redirect hot gases into the exhaust gap. Spiral flighting along the exhaust gap spirals the exhaust gas to keep the hot gases collecting along the top of the heat exchanger. The gases pass out of the exhaust gap through a flume at the first exhaust tube end. The furnace duct and the exhaust tube are connected together at at most one axial position to accommodate different amounts of axial expansion. The heat exchanger is supported by an expansion mount at the second end of the exhaust tube and by a stationary mount at the first end of the furnace tube.

9 Claims, 3 Drawing Figures

DIRTY WATER HEAT EXCHANGER

BACKGROUND OF THE INVENTION

This invention relates to heat exchangers, more particularly to a heat exchanger particularly useful for heating dirty wash water.

During many industrial cleaning processes the washing fluid, often water or some other solvent, is heated to enhance its cleaning effectiveness. Some containers, such as railroad tank cars, have large amounts of solid residue built up in them. This residue is usually loosened by spraying a heated cleaning liquid and is carried away by the wash liquid.

In some cases it is desirable to re-use the wash liquid after removing the solid matter. The solids in the wash liquid are commonly eliminated by allowing the dirty wash liquid to remain undisturbed in a settling tank. However, some of the solid particles, including sand, dirt and gravel, may not all be removed from the cleaning liquid. These solids have a tendency to precipitate out while passing through a conventional heat exchanger. This can cause hot spots in the heat exchanger which, in addition to reducing the efficiency of heat transfer, may eventually cause the heat exchanger to buckle and fail.

Another problem associated with heat exchangers involves the differences in the amount various components expand and contract according to their temperatures. The requirement that the designer accommodate this differential expansion factor often results in a design which is more complicated, and therefore more expensive to build, than would otherwise be the case.

SUMMARY OF THE INVENTION

The present invention solves the problem of solid matter precipitating out in the heat exchanger and accommodates the problems created by differential expansion and contraction in a simple, inexpensive, straightforward manner.

The heat exchanger of the invention is particularly useful for heating dirty wash liquid because it prevents solids from settling out while passing through it. The wash liquid will often be referred to in this application as wash water; however, it is to be understood that wash water includes other cleaning liquids as well. The heat exchanger includes a cylindrical furnace tube surrounded by a spiral wash water heating duct along which the dirty water passes. The spiral heating duct extends substantially the entire length of furnace tube and is preferably integrally constructed with the furnace tube. The furnace tube and spiral heating duct are collectively termed the furnace duct.

A conventional burner is mounted to the first end of the furnace duct and injects hot gases into the furnace duct. The second end of the furnace duct is open. An exhaust tube fits over the second end of the furnace duct and surrounds the furnace duct. The exhaust tube defines a return pathway for the hot gases to flow between the outer surface of the spiral liquid heating duct and the exhaust tube from the second end of the furnace duct to a position just short of the first end of the furnace duct. Exhaust gases pass from the exhaust tube through a flume adjacent the first end of the exhaust tube. The dirty water enters the spiral liquid heating duct adjacent the burner, that is at the first end of the furnace tube, and exits at the second end of the furnace tube.

Spiral flighting between the exhaust tube and the spiral liquid heating duct causes the exhaust gases to flow in a spiral path as they move between the heat exchanger's second and first ends to keep the hot gases from collecting along the top of the heat exchanger.

To compensate for the differential expansion between the furnace duct and the exhaust tubes, the furnace duct and the exhaust tube are connected together at a rigid connection at at most one point, typically the dirty water outlet at the end of the heat exchanger. The heat exchanger is preferably supported at the second end of the exhaust tube and the first end of the furnace duct. Assuming the furnace duct and exhaust tubes are rigidly connected at one point, then at least one of the heat exchanger supports is an expansion joint. In the preferred embodiment the first end of the exhaust tube is slidably mounted to and supported by a slip joint.

A key feature of the invention is the provision of the spiral liquid heating duct sized to ensure adequate turbulence and velocity of the dirty water to be heated to keep solid material from precipitating out. Also, the spiral liquid heating duct heats the water more efficiently by virtue of the turbulence and also because the spiral flighting between the outer shell of the spiral liquid heating duct and the furnace tube acts as a heat transfer fin.

Another significant feature of the invention is the manner in which the exhaust tube and the furnace duct are mounted to one another using slip joints to allow for difference in expansion between the two. It has been found that for a heat exchanger 20 feet long, the increase in length of the exhaust tube was about one inch greater than the increase length of the furnace duct under normal operating conditions. This differential in expansion is accommodated by rigidly coupling the furnace duct and exhaust tube together at not more than one axial position. Doing so permits axial slippage between the two due to this differential expansion and contraction.

Providing the spiral flighting between the furnace duct and exhaust tube causes the hot gases to flow in a spiral pattern within the exhaust chamber. This keeps the hot gases from collecting along the top of the heat exchanger for increased efficiency.

Other features and advantages of the present invention will appear from the following description in which the preferred embodiment is set forth in detail in conjunction with the accompanying drawings.

DETAILED DESCRIPTION OF THE PREFERRED EMBODIMENT

Figure 1:
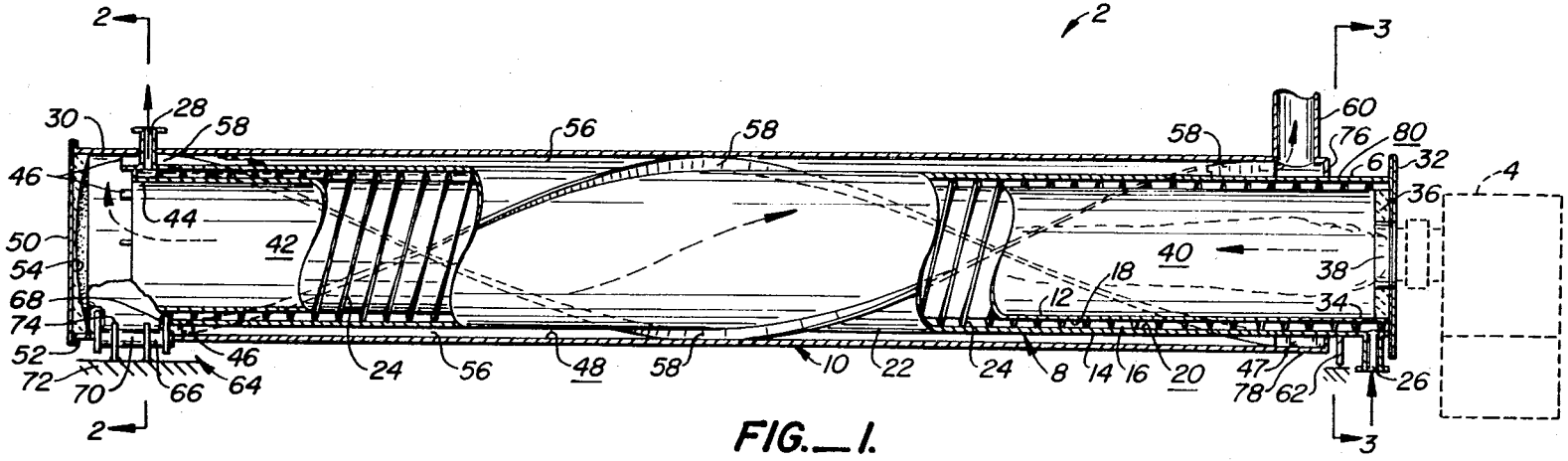
FIG. 1 is a side view of the heat exchanger of the invention with portions broken away.
Figure 3:
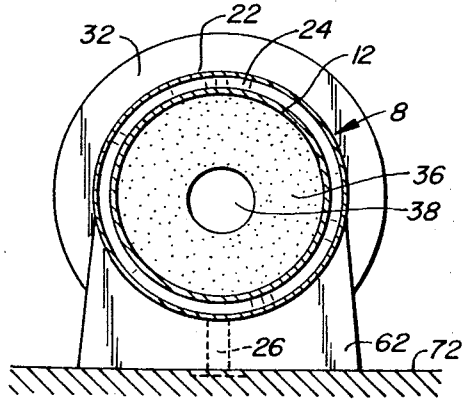
FIG. 3 is a cross-sectional view taken along line 3—3 of FIG. 1.
Figure 2:
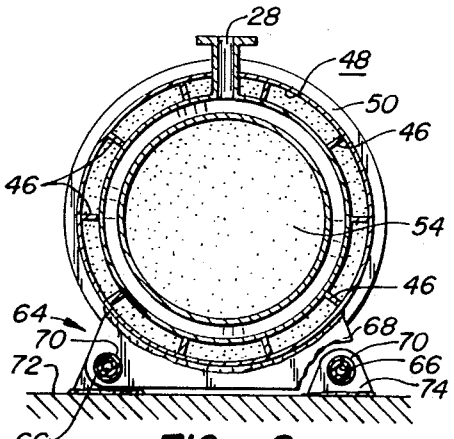
FIG. 2 is a cross-sectional view taken along line 2—2 of FIG. 1.

Referring now to the figures, a heat exchanger 2 made according to the invention is shown with a conventional burner 4 mounted to a first end 6 of the heat exchanger. Heat exchanger 2 includes broadly a cylindrical furnace duct 8 mounted within a cylindrical exhaust tube 10. Furnace duct 8 includes a cylindrical furnace tube 12 and a spiral liquid heating duct 14 formed integrally with and mounted rigidly to the outside of furnace tube 12 along the entire length of the furnace tube. A spiral liquid pathway 16 is defined along the length of furnace duct 8 by the outer surface 18 of furnace tube 12, the inner surface 20 of the outer shell 22 of spiral heating duct 14 and the spiral flighting 24 mounted between furnace tube 12 and outer shell 22. A liquid inlet 26 is provided to duct 14 at first end 6 of heat exchanger 2 while a liquid outlet 28 is positioned at the second or outer end 30 of heat exchanger 2.

A burner mounting plate 32 is mounted to the first end 34 of furnace duct 8. A ring of refractory material 36 is mounted to plate 32 within furnace duct 8. Plate 32 and ring 36 define a circular opening 38 through which flames and hot gases 40 from burner 4 pass into the cylindrical hot gas chamber 42 defined within furnace duct 8.

Exhaust tube 10 extends from a position forward or in front of the second end 44 of furnace duct 8 to a position short of the first end 34 of furnace duct 8. Exhaust tube 10 is larger in diameter than furnace duct 8 and is radially centered about the furnace duct by ten radially and longitudinally directed spacer plates 46, 47 at each end of exhaust tube 10. Spacer plates 46, 47 are secured, such as by welding, to the inner surface 48 of exhaust tube 10. However, spacer plates 46, 47 are not fastened to furnace duct 8 to permit any relative axial movement of furnace duct 8 and exhaust tube 10 due to differences in thermal expansion and contraction such as occurs when heat exchanger 2 is first fired up.

End plate 50 covers the second or outer end 52 of exhaust tube 10 and has a concave layer of refractory material 54 on its inner surface for directing hot gases 40 from hot gas chamber 42, past second end 44 of furnace duct 8, past spacer plates 46 and into an exhaust gap 56 defined between exhaust tube 10 and furnace duct 8. To keep hot gases 40 from collecting within exhaust gap 56 along the top of heat exchanger 2, a pair of spiral flights 58 are wrapped around furnace duct 8 within gap 56 one complete turn each. This causes very little resistance to the flow of hot gases 40, but keeps the gases from collecting along the top of heat exchanger 2. Hot gases 40 are exhausted into the atmosphere through a flume 60 in exhaust tube 10.

First end 6 of heat exchanger 2 is supported on a support surface 72 by a stationary mount 62 welded directly to furnace duct 8. Second end 30 of heat exchanger 2 is supported by a slip tube expansion mount 64. Mount 64 includes a pair of inner tubes 66 mounted to exhaust tube 10 by a pair of brackets 68 and a pair of outer tubes 70 slidably housing inner tubes 66. Outer tubes 70 are supported on support surface 72 by brackets 74.

A slip ring 76 is mounted to the first end 78 of exhaust tube 10 so to be in sliding, sealing engagement with the outer surface 80 of outer shell 22. This keeps hot gases 40 from escaping through the gap between tube 10 and duct 8 at first end 6 of heat exchanger 2.

During operation exhaust tube 10 expands axially more than furnace duct 8 because furnace duct 8 is kept cooler than exhaust tube 10 by the liquid flowing through pathway 16. This causes tube 10 to change in length more than duct 8. In the preferred embodiment expansion mount 64 is provided at second end 52 of exhaust tube 10. Also, liquid outlet 28 is, in the preferred embodiment, rigidly attached to both furnace duct 8 and exhaust tube 10 thus tying these members together at one axial position. If exhaust tube 10 and furnace duct 8 were not rigidly connected to one another, then expansion mount 64 could be replaced by a fixed or a stationary mount since exhaust tube 10 and furnace duct 8 would still be free to expand and contract. In any event, furnace duct 8 and exhaust tube 10 should not be rigidly fastened together at two axially spaced-apart points since this would inhibit differential expansion.

In use, liquid to be heated, typically dirty water containing suspended solid material, is pumped into inlet 26 and flows along spiral pathway 16 which surrounds hot gas chamber 42. Flame and hot gases 40 from burner 4 heat furnace duct 8 and thus the liquid within pathway 16 as it flows through the pathway. The hot gases flow the entire length of furnace duct 8, reverse direction at the outer or second end 30 of heat exchanger 2 and then flow through gap 56 back along the outside of furnace duct 8 to continue heating the water within pathway 16. Hot gases 40, after passing through exhaust gap 56, pass out of heat exchanger 2 through flume 60. The liquid, after flowing through pathway 16, flows out outlet 28 for further use or processing. Because of the high speed and turbulence in pathway 16, solid material will not settle out along the pathway for better efficiency; hot spots, which can be caused by deposits of solids along a flow path, are also eliminated by the use of spiral pathway 16.

Modification and variation can be made to the disclosed embodiment without departing from the subject of the invention as defined in the following claims.

I claim:

1. A heat exchanger, for use with a burner which produces hot gases, comprising:

a cylindrical furnace duct having a first end connected to the burner for receipt of the hot gases and an open second end, said furnace duct defining a heater chamber therein;

said furnace duct including a spiral liquid heating path surrounding at least a part of said heater chamber, said spiral path having a liquid inlet and a liquid outlet;

an exhaust tube spaced apart from and surrounding at least a portion of the length of said furnace duct to define an exhaust gap therebetween, said exhaust tube having first and second ends, said second exhaust tube end being closed and surrounding said second furnace end to direct hot gases from said heater chamber, past said furnace duct second end and into said exhaust gap, said first exhaust tube end having an exhaust gas outlet, whereby the hot gases make a double pass and the heated liquid makes a single pass through the heat exchanger;

means for mounting said furnace duct and said exhaust tube to one another, said mounting means securing said furnace duct to said exhaust tube at no more than one axial position to accommodate differential expansion between the furnace duct and the exhaust tube;

a stationary mount secured to said first furnace duct end and a sliding support secured to said second exhaust tube end to accommodate differential axial expansion and contraction of said heat exchanger; and a slip joint mounting means allowing relative axial movement between said furnace duct and said exhaust tube, including radially oriented and axially extending spacer plates secured to one of said furnace duct and exhaust tube; and means for supporting said heat exchanger in a chosen position.

2. The heat exchanger of claim 1 further comprising means for directing the hot gases through said exhaust gap along a spiral path as the hot gases flow from said furnace duct second end to said exhaust gas outlet.

3. The heat exchanger of claim 2 wherein said spiral path directing means includes at least two spiral flights mounted within said exhaust gap, each said flight making one complete revolution about said furnace duct.

4. The heat exchanger of claim 1 wherein said heater chamber defines a single, straight, substantially unobstructive path.

5. The heat exchanger of claim 1, wherein said spacer plates are at said first and second exhaust tube ends.

6. The heat exchanger of claim 1 further comprising a slip sealing joint at said first exhaust tube end for preventing hot gases within said exhaust gap from escaping past an area between said first exhaust tube and said furnace duct.

7. The heat exchanger of claim 1 wherein said liquid inlet is near said first furnace tube end and said liquid outlet is near said second furnace tube end.

8. A dirty liquid heat exchanger for use with a source of hot gases comprising:

an elongate, horizontally positioned cylindrical furnace duct having a first end fluidly coupled to the hot gases source and an open second end, said furnace duct defining a substantially unobstructed hot gas chamber therein, said furnace duct including a means for advancing dirty liquid through a spiral liquid heating duct along a spiral path from a liquid inlet at the first furnace duct and to a liquid outlet at the second furnace duct end, said spiral path sized and configured to keep particles in the dirty liquid from settling out in the spiral liquid heating duct;

an elongate exhaust tube surrounding substantially the entire length of said furnace duct and having a first end movably mounted to said furnace duct first end and having a second sealed end spaced apart from and surrounding said furnace duct second end, said exhaust tube and said furnace duct defining an annular exhaust chamber therebetween from said second furnace duct end to said first exhaust tube end, said furnace duct and said exhaust tube being rigidly fixed to one another at a single axial position at said second furnace duct end;

spiral guide means for creating at least one spiral exhaust gas path in said exhaust chamber so the hot gases spiral about said spiral liquid heating duct as the hot gases pass through said exhaust chamber;

a first mount at said first furnace duct end for supporting a first end of the heat exchanger; and a second, expansion type mount spaced apart from said first mount and secured to said exhaust tube for supporting a second end of the heat exchanger while permitting the heat exchanger to expand and contract axially.

9. The heat exchanger of claim 1 wherein said chosen position is a horizontal position.

* * * * *